US007401615B2

(12) United States Patent
Kuo

(10) Patent No.: US 7,401,615 B2
(45) **Date of Patent: *Jul. 22, 2008**

(54) MANUAL-OPENED AND AUTO-CLOSED UMBRELLA

(76) Inventor: Shih-Shin Kuo, 8F, No. 39, Sau Nien Street, Hsinchu City (TW)

( * ) Notice: Subject to any disclaimer, the term of this patent is extended or adjusted under 35 U.S.C. 154(b) by 195 days.

This patent is subject to a terminal disclaimer.

(21) Appl. No.: 11/362,874

(22) Filed: Feb. 28, 2006

(65) Prior Publication Data

US 2007/0199585 A1 Aug. 30, 2007

(51) Int. Cl.
*A45B 25/16* (2006.01)
*A45B 25/14* (2006.01)
*A45B 19/04* (2006.01)
*A45B 19/08* (2006.01)

(52) U.S. Cl. ..... 135/22; 135/24; 135/20.3; 135/25.4

(58) Field of Classification Search ..... 135/20.3, 135/22, 24, 25.1, 25.4
See application file for complete search history.

(56) References Cited

U.S. PATENT DOCUMENTS 4,548,222 A * 10/1985 Day ..... 135/24
5,161,562 A * 11/1992 Wu ..... 135/20.3
5,309,932 A * 5/1994 Chou et al. ..... 135/22
5,441,065 A * 8/1995 Lin et al. ..... 135/24
5,483,985 A * 1/1996 Yu ..... 135/22
5,533,541 A * 7/1996 Cheng et al. ..... 135/22
5,823,215 A * 10/1998 Chou et al. ..... 135/24
6,701,946 B2 * 3/2004 You ..... 135/22
6,810,894 B2 * 11/2004 Chen ..... 135/22
6,817,371 B2 * 11/2004 Lin et al. ..... 135/24
2004/0221884 A1 * 11/2004 Yang ..... 135/24
2005/0257817 A1 * 11/2005 Kuo ..... 135/24
2007/0017561 A1 * 1/2007 Kuo ..... 135/22
2007/0131263 A1 * 6/2007 Kuo ..... 135/25.1

* cited by examiner

*Primary Examiner*—David R Dunn
*Assistant Examiner*—Tania Abraham
(74) *Attorney, Agent, or Firm*—Rosenberg, Klein & Lee

(57) ABSTRACT

The invention relates to a manual-opened and auto-closed umbrella, which utilizes two springs provided around a shaft and therein accompanying with a runner and a frame to control the umbrella being opened manually and closed automatically. The umbrella is to be opened manually that compresses the springs at the same time, and by a touch to automatically close the umbrella. The manual-opened and auto-closed umbrella therefore obtains a certain utilization and improvement.

2 Claims, 7 Drawing Sheets

MANUAL-OPENED AND AUTO-CLOSED UMBRELLA

BACKGROUND OF THE INVENTION

Traditional umbrellas include a manually operated umbrella and an automatically one, wherein the automatically umbrella is usually to be said an auto-opened and manual-closed umbrella. There is a known improved umbrella can be opened and closed automatically. But this full-auto umbrella has a very complex structure and is broken usually after using a little period of time, such as U.S. Pat. No. 5,617,889.

The present invention is to provide a new and different umbrella, which has a simpler structure for being manually opened and automatically closed. Now, accompanying with the following drawings, the character of the present invention will be described here and after.

DETAILED DESCRIPTION OF THE PREFERRED EMBODIMENT

Figure 1:
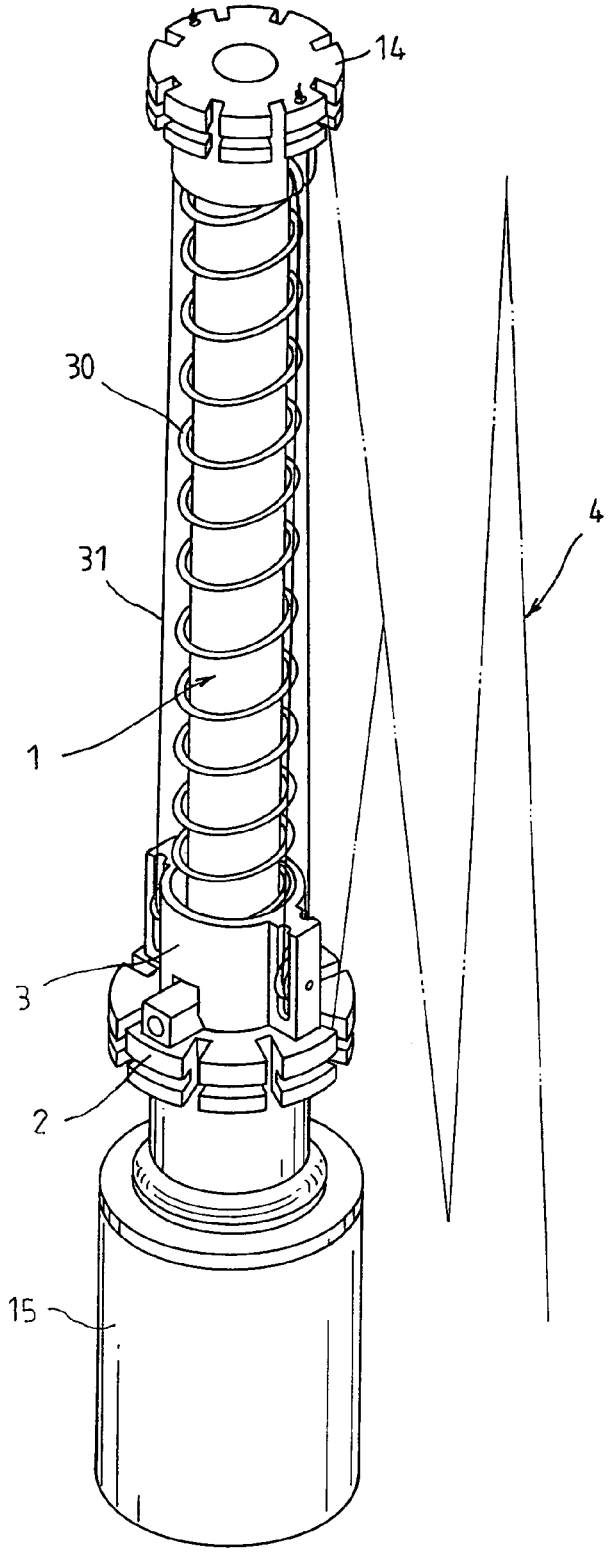
FIG. 1 is a perspective view showing a main portion of a manual-opened and auto-closed umbrella according to the present invention.

Referring to FIG. 1 to 5, the present invention relates to an improved umbrella, which can be manually opened and automatically closed, which includes a shaft (1) being consisted by several tubes. In this embodiment for explanation, the shaft (1) includes an outer tube (11), a middle tube (12), and an inner tube (13). A handle (15) with a button (151) is connected with lower end of the shaft (1) and an upper joint (14) is connected with top end of the shaft (1). A runner (2) provided around the shaft (1). A double-ears receiver (3) is provided around the shaft (1) above the runner (2). A control-closing spring (30) is also provided around the shaft (1) between the upper joint (14) and the receiver (3). The umbrella frame (4) has its inner ends pivoted with the upper joint (14) and the runner (2). By use of movement of the runner, the frame (4) is expended to open the umbrella or is concentrated to close the umbrella.

Figure 2:
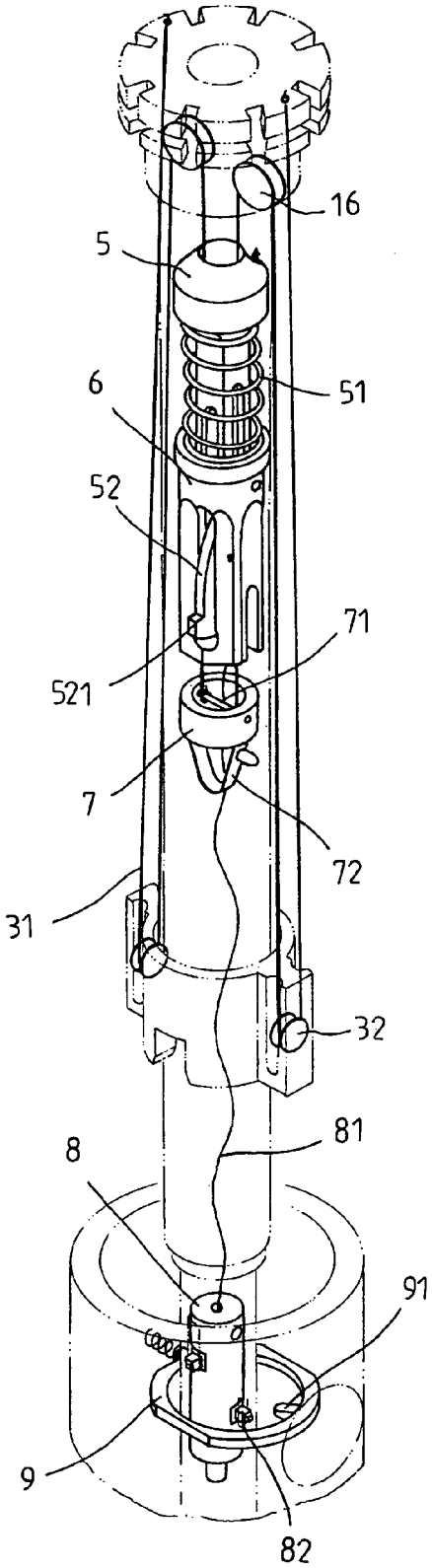
FIG. 2 is a perspective view showing the inner apparatus of FIG. 1.

As shown in FIG. 2, an upper controller (5) and a middle fixer (6) with an inner spring (51) therebetween are provided in the shaft (1). A bow (52) received in the upper controller (5) has its lower hook end (521) extend outward from a slot (61) of the middle fixer (6). A lower fixer (7) placed below middle fixer (6) has a rod (71) for winding inner ends of two ropes (31), both of which have their outer end extend upward to pass around a related wheel (16) under the upper joint (14), then downward to pass around another wheel (32) on the receiver (3), and at last upward to connect with the upper joint (14), meanwhile the ropes (31) are kept in tension always. The lower fixer (7) has a bottom V-shaped elastic slice (72). An inner controller (8) received in a lower inside position of the shaft (1) connects with the lowest end of an inner wire (81) having its top end connect with the upper controller (5). The inner controller (8) is provided with a side projection (82) facing the button (151) of the handle (15). A loop (9) placed in the handle (15) has a convex (91) opposite to the button (151) and face the projection (82) of the inner controller (8).

Figure 3:
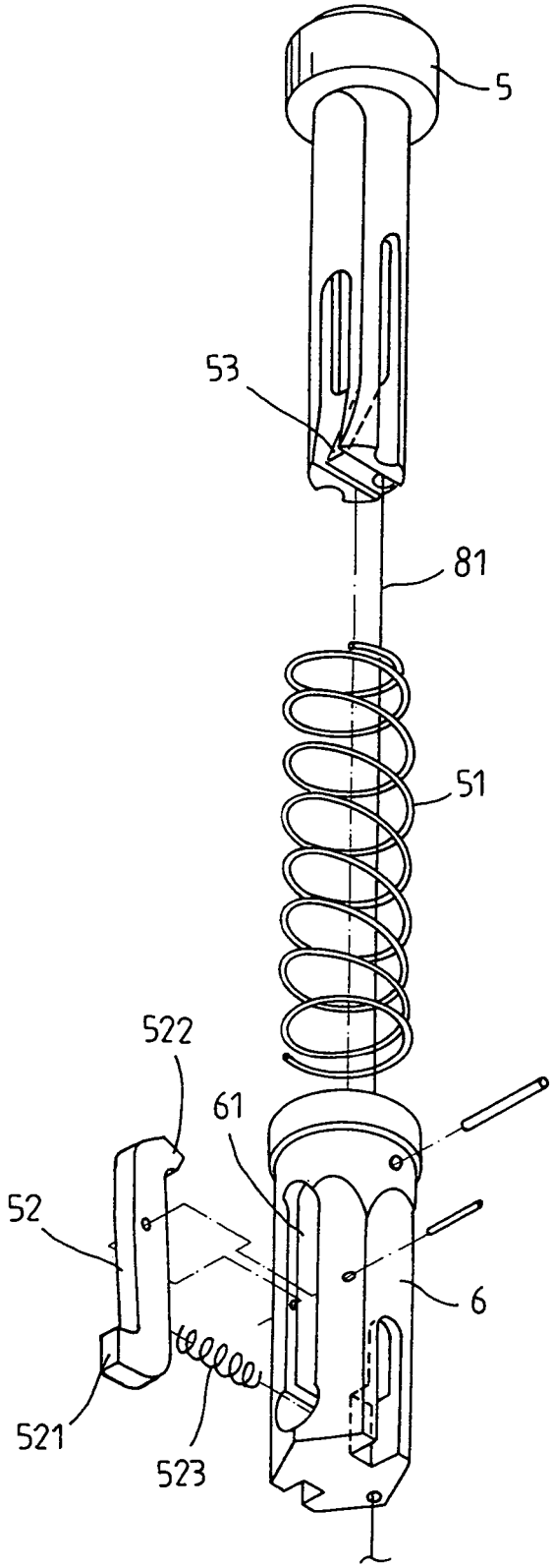
FIG. 3 is an exploded perspective view showing a portion of FIG. 2.

Please refer to FIG. 3, the upper controller (5) has its lower side an inclined plane (53) and the bow (52) has a top inner hook (522) and a lower hook end (521), wherein a small spring (523) is placed inside the lower hook end (521) to provide a stable elastic force for push the lower end outward.

Figure 4:
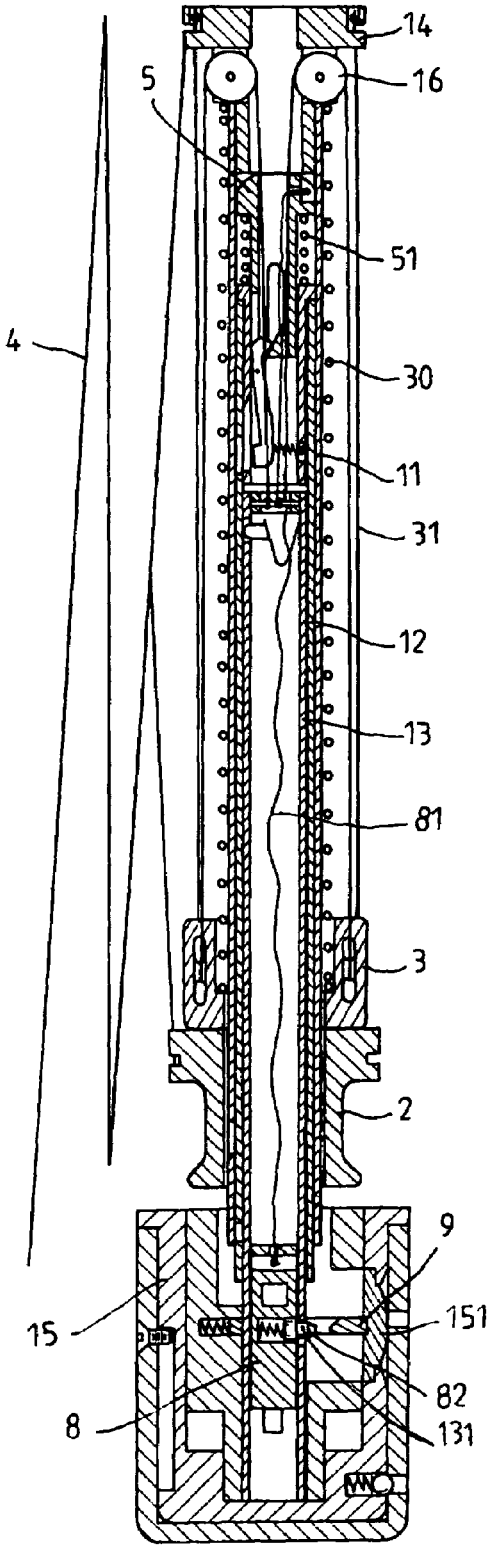
FIG. 4 is a cross-sectional plan view showing the umbrella being closed according to the present invention.
Figure 5:
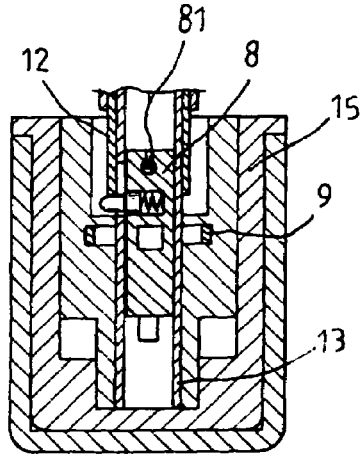
FIG. 5 is a cross-sectional plan view showing a handle of the automatic collapsible umbrella of FIG. 4 at a perpendicular plane.

As in FIGS. 4 and 5, when the umbrella is in closed state, the projection (82) is stopped in a slot (131) of the inner tube (13). At this time, the control-closing spring (30) and the inner spring (51) are prolonged, and the inner wire (81) is released. The frame (4) is closed beside the shaft (1) and the receiver (3) contacts with the runner (2) far away from the upper joint (14) that the umbrella is closed stably.

Figures 6, 7:
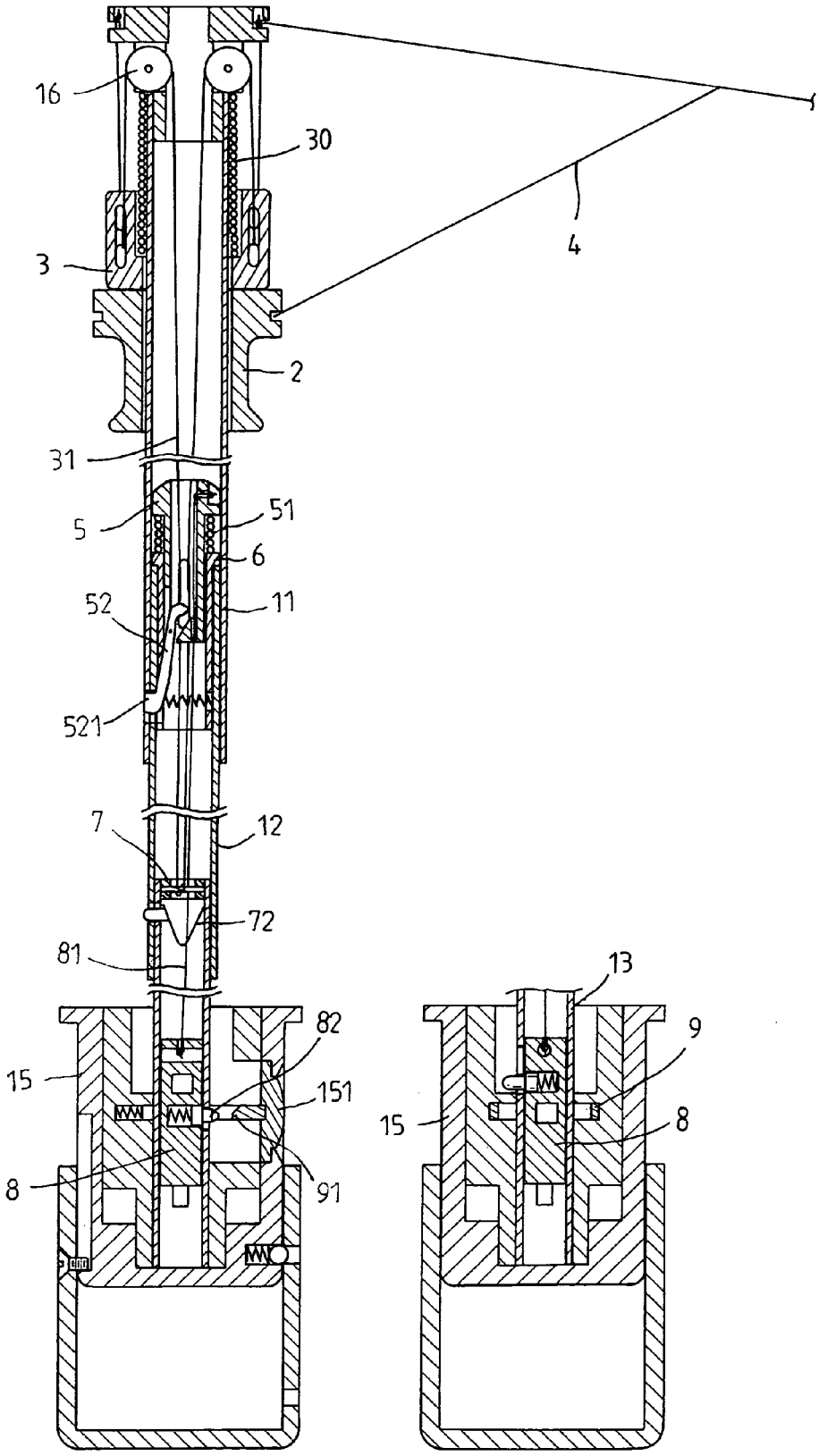
FIG. 6 is a cross-sectional plan view showing the umbrella being opened according to the present invention.
FIG. 7 is a cross-sectional plan view showing the umbrella handle of FIG. 8 at a perpendicular plane.
Figures 8, 9:
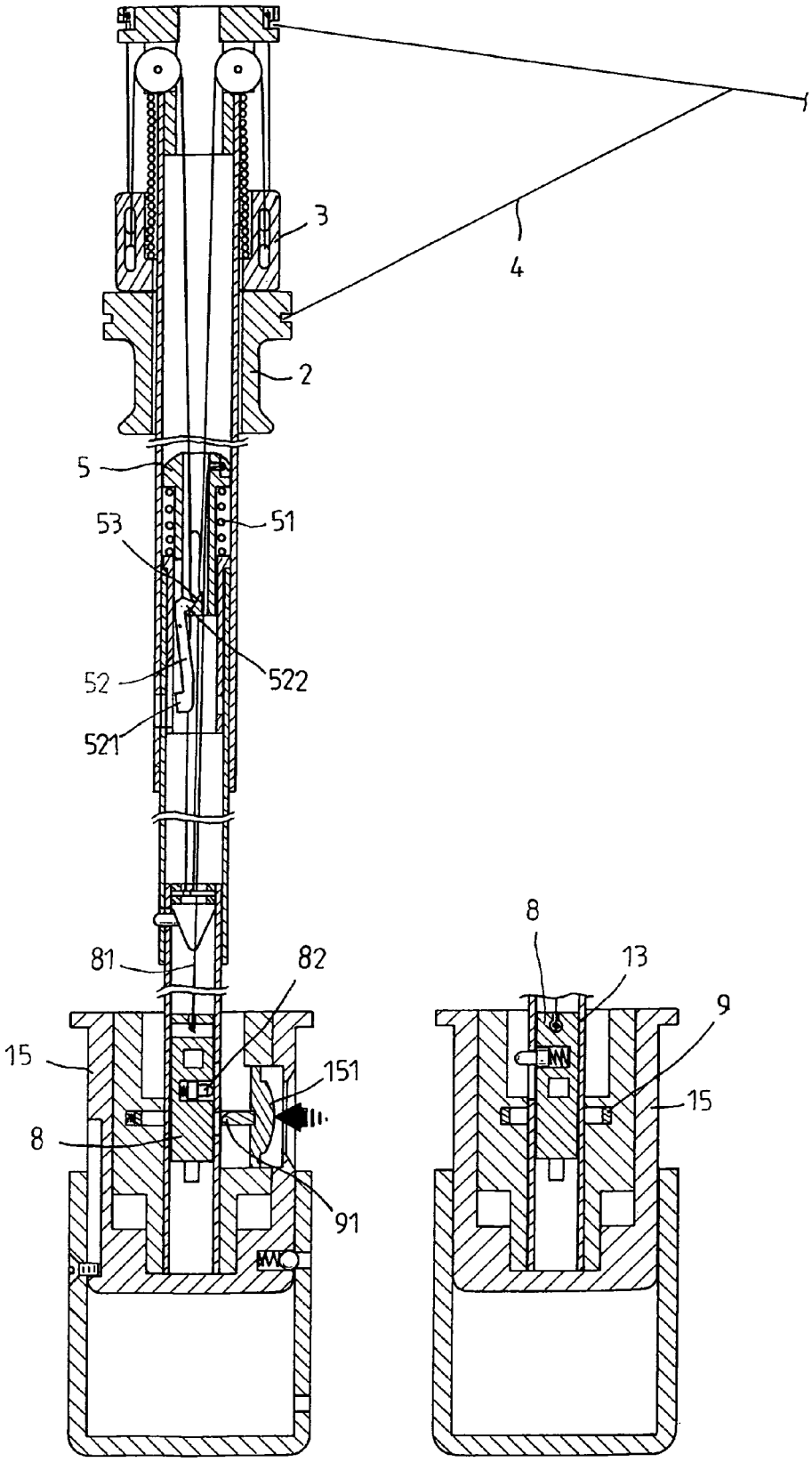
FIG. 8 is a first cross-sectional plan view showing the umbrella being closing according to the present invention.
FIG. 9 is a cross-sectional plan view showing the umbrella handle of FIG. 8 at a perpendicular plane.
Figures 10, 11:
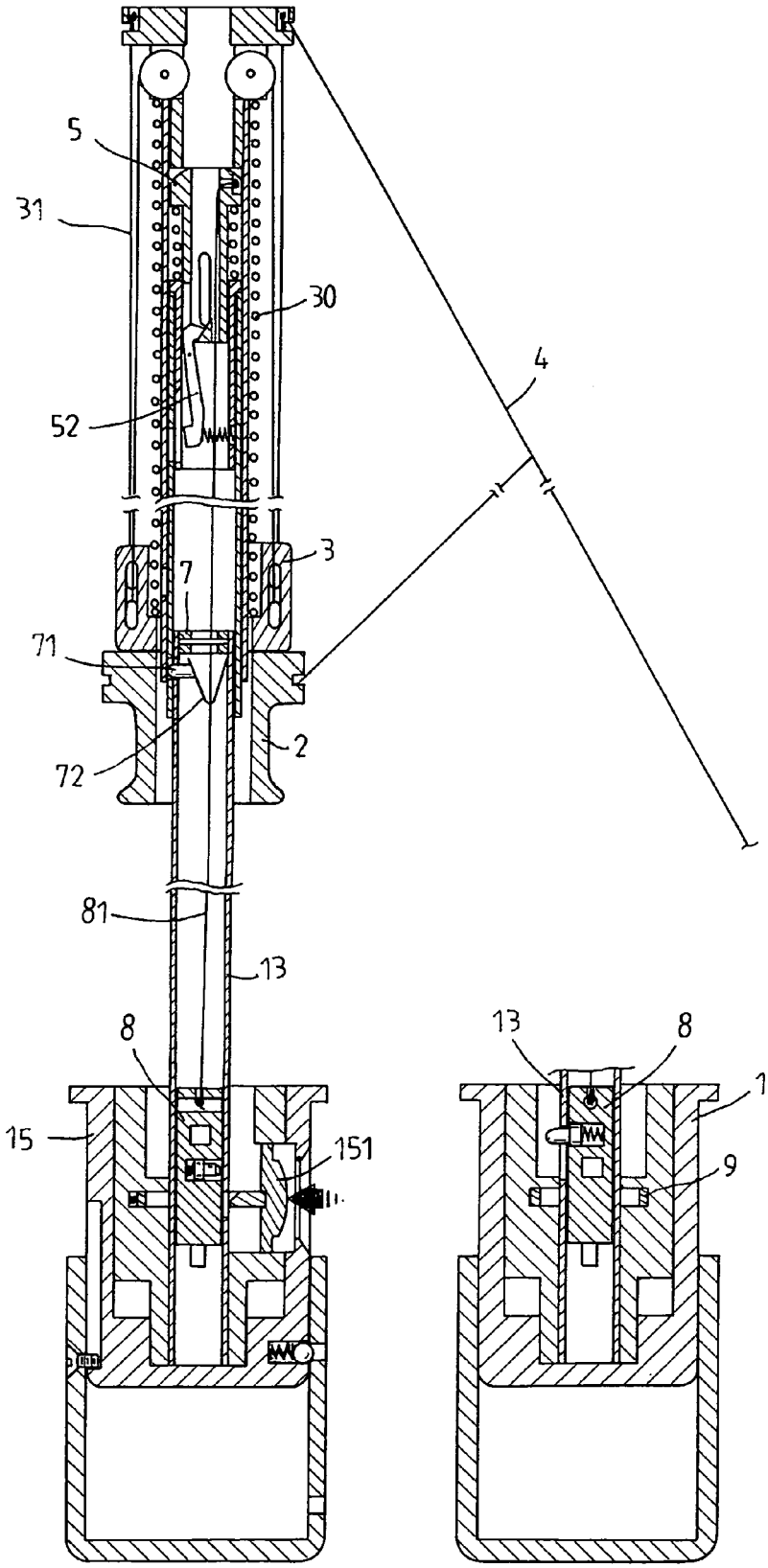
FIG. 10 is a second cross-sectional plan view showing the umbrella being closed according to the present invention.
FIG. 11 is a cross-sectional plan view showing the umbrella handle of FIG. 10 at a perpendicular plane.

In use, the umbrella is to be opened manually by pushing the runner (2) upward that the shaft (1) is prolonged and the frame (4) is expanded to open the umbrella as shown in FIGS. 6 and 7. At the moment, the control-closing spring (30) and the inner spring (51) are compressed and positioned.

To close the umbrella, referring to FIG. 8 to 11, when the user pushes the button (151), the projection (82) will be pushed and released from the inner tube (13). Both upper controller (5) and inner controller (8) are capable of moving upward, meanwhile the lower inclined plane (53) will push the top inner hook (522) of the bow (52) to force the lower hook end (521) to move inward and release the engagement between the middle tube (12) and the outer tube (11). So, the middle tube (12) moves upward to be received in the outer tube (11) and then the outer tube (11) moves downward to press the V-shaped slice (72) to release the engagement between the middle tube (12) and the inner tube (13). At this time, the lower fixer (7) moves upward since the ropes (31) are not limited anymore. Therefore, the control-closing spring (30) can rapidly extended to force the receiver (3) and the runner (2) downward that pulls the frame (4) concentrated to the shaft (1) and closes the umbrella automatically.

If a user wants to use the umbrella again, he just needs to repeat the above operation, i.e. to push the runner for opening the umbrella, and a force on button of the handle to automatically close the umbrella. Thus, we can find that the operation of the present invention is totally different from the prior art and is useful for people to apply the umbrella as normal. Moreover, it can be understood that the above-mentioned embodiments including a frame with three folded ribs are only exemplary of the present invention. Any modification, such as a frame with four or more ribs and a shaft with four or more tubes, having the same or similar merit is still claimed in this application.

I claim:

1. A manual-opened and auto-closed umbrella including a shaft being consisted by at least three tubes, which includes an outer tube, a middle tube, and an inner tube, a handle with a button connected with a lower end of the shaft and an upper joint connected with a top end of the shaft; a runner provided around the shaft, a double-ears receiver provided around the shaft above the runner, a control-closing spring also provided around the shaft between the upper joint and the receiver; the umbrella frame having its inner ends pivoted with the upper joint and the runner, and by use of movement of the runner, the frame is expanded to open the umbrella or concentrated to close the umbrella; an upper controller and a middle fixer with an inner spring therebetween provided in the shaft, a bow received in the upper controller having a lower hook end extend outward from a slot of the middle fixer, a lower fixer placed below middle fixer having a rod for winding inner ends of two ropes, both of which have their outer end extend upward to pass around a related wheel under the upper joint, then downward to pass around another wheel on the receiver, and at last upward to connect with the upper joint, meanwhile the ropes being kept in tension always; the lower fixer having a bottom V-shaped elastic slice, an inner controller received in a lower inside position of the shaft connecting with the bottom end of an inner wire, which has its top end connect with the upper controller, the inner controller provided with a side projection facing the button of the handle, a loop placed in the handle having a convex opposite to the button and facing a head of the inner controller.

2. The manual-opened and auto-closed umbrella as claimed in claim 1, wherein the frame of the umbrella includes four or more ribs and the shaft also includes four or more tubes.

* * * * *